United States Patent [19]

Roerig et al.

[11] Patent Number: 4,517,056

[45] Date of Patent: May 14, 1985

[54] SLICE LIP ADJUSTMENT

[75] Inventors: Arnold J. Roerig; Robert W. Schroeder, both of Beloit, Wis.

[73] Assignee: Beloit Corporation, Beloit, Wis.

[21] Appl. No.: 556,896

[22] Filed: Dec. 1, 1983

[51] Int. Cl.[3] ..... D21F 1/02; D21F 1/04; D21F 1/06

[52] U.S. Cl. ..... 162/344; 162/347

[58] Field of Search ..... 162/344, 345, 346, 347, 162/259, 262, 263

[56] References Cited

U.S. PATENT DOCUMENTS

| | | | |
|---|---|---|---|
| 2,637,250 | 5/1953 | Teale | 162/347 |
| 3,167,470 | 1/1965 | Moore | 162/347 |
| 3,888,729 | 6/1975 | Parker et al. | 162/344 |
| 3,994,773 | 11/1976 | Wolf et al. | 162/347 |
| 4,342,619 | 8/1982 | Gladh | 162/347 |
| 4,373,993 | 2/1983 | Fijiwara | 162/347 |

FOREIGN PATENT DOCUMENTS

| | | | |
|---|---|---|---|
| 1197000 | 7/1970 | United Kingdom | 162/344 |

OTHER PUBLICATIONS

Carlstedt et al., "Development and Design of the KMW Headbox for Fourdriniers", Paper Trade Journal, Sep. 11, 1972, pp. 44–49.

Beloit Corporation, "Headbox Slice Lip and Slice Lip Adjusters", Manual J 006-10004, Feb. 1978.

*Primary Examiner*—S. Leon Bashore
*Assistant Examiner*—Karen M. Hastings
*Attorney, Agent, or Firm*—Hill, Van Santen, Steadman & Simpson

[57] ABSTRACT

A device for use in conjunction with a slice lip adjusting mechanism for controlling the distribution of stock across the web of a paper machine to obtain a desired cross-machine profile of basis weight, moisture, caliper and the like. The device is used in conjunction with a slice body and a slice lip which abuts the body but is at least slightly movable relative thereto. An apertured adjusting arm engages the slice lip for fine adjustment of the lip position. Disengagement between the adjusting arm and the slice lip is prevented by a headed bolt which passes through the aperture in the adjusting arm and is received in threaded engagement in the slice body, in combination with a plug which is received in threaded engagement at the head of the bolt and a compressed spring which acts between the plug and the adjusting arm. A tube is provided with an internally threaded portion receiving the plug in threaded engagement at one end, with the opposite end of the tube being spaced from the adjusting arm by a small predetermined clearance thereby limiting the extent to which the adjusting arm can move away from engagement with the slice lip. Locking means are provided to lock the tube in an adjustable position relative to the plug.

5 Claims, 4 Drawing Figures

FIG. 1
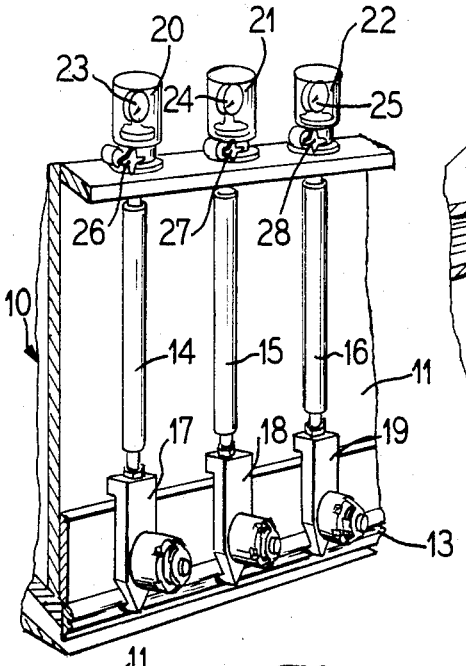
FIG. 2
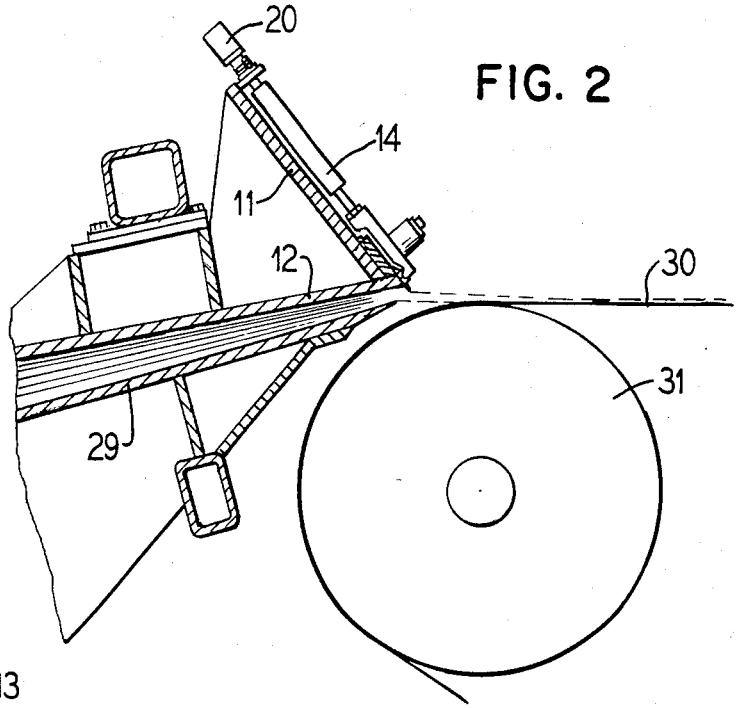
FIG. 3
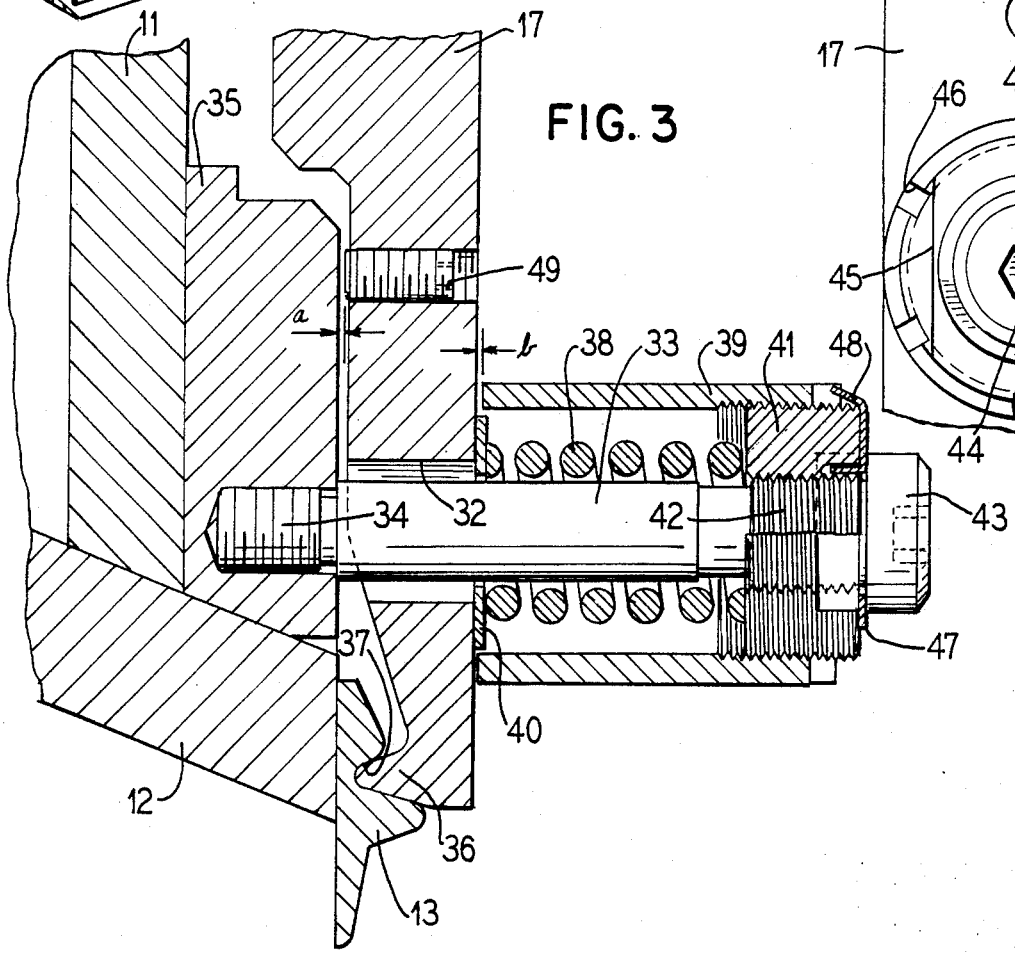
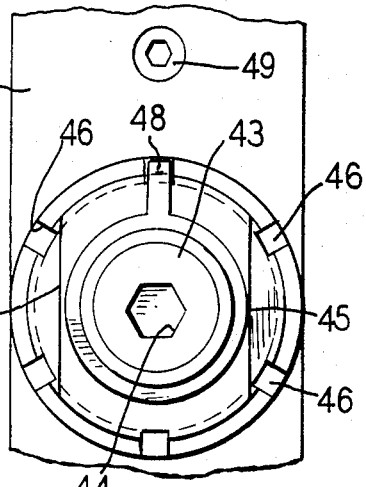
FIG. 4

SLICE LIP ADJUSTMENT

BACKGROUND OF THE INVENTION

1. Field of the Invention

This invention is in the field of slice lip adjusting devices wherein disengagement or disorientation between the slice lip and the adjusting arm are prevented.

2. Description of the Prior Art

The prior art contains numerous examples of papermaking machines provides with means for controlling the slice opening to thereby vary the profile of the paper in the cross-machine direction with respect to basis weight, moisture, caliper and the like.

Beachler U.S. Pat. No. 3,014,527 describes a paper machine having a generally triangular shaped headbox wherein there is an inlet provided at one apex of the triangle and a stock outlet at another apex, together with pivot means at the third apex which permits an associated wall to move relative to another wall forming the triangular headbox. The device provides direct means for matching the flow rates of stock to the paper machine speed, stock character, and basis weight of the sheet to be formed on the machine by varying a plurality of adjustable throat dimensions in the inlet.

Beecher U.S. Pat. No. 3,413,192 is directed to a more sophisticated automatic type slice adjusting mechanism. The slot aperture at the slice is made variably adjustable along the length by adjusting mechanisms which are controlled directly or indirectly by servo-integrators each consisting of a servo-operational amplifier having its output connected to a servo-motor the shaft of which mounts a tachometer which feeds back information to the input of an amplifier which ultimately readjusts the slot opening.

U.S. Pat. No. 3,902,961 in which one of the present coinventors was a copatentee describes a papermaking machine having a slice lip construction for controlling the trajectory of stock emerging from the headbox slice by deflecting the stock stream downwardly against the forming wire and changing the deflection with change in size of slice opening to maintain an optimum slice strain angle relative to the wire.

In U.S. Pat. No. 3,167,470 there is described a paper machine headbox having an adjustable slice which is adjustable horizontally and vertically. The vertical adjustment is accomplished by changing the positioning of a plurality of clamp blocks while horizontal adjustment is accomplished by a pivotal mounting.

Mehlman et al U.S. Pat. No. 3,542,645 describes a papermaking machine with an adjustable slice lip utilizing screw adjusting mechanisms, each screw having two ratchet wheels which are adapted to be engaged by a pawl connected to an electrical solenoid, one solenoid operating to turn the screw in one direction and the other to turn it in the opposite direction.

U.S. Pat. No. 3,556,935 provides for an adjustable pressure nozzle with means for adjusting the convergence angles or vertical tapers in the nozzle approach channels.

U.S. Pat. No. 3,575,799 provides an adjustable slice opening which is achieved by providing a turnbuckle assembly including a threaded adjusting rod secured to the upper lip of the slice opening, and a turnbuckle sleeve member which threadedly engages the adjusting rod to move the adjusting rod vertically and thereby adjust the upper lip of the slice opening.

U.S. Pat. No. 3,703,436 describes a headbox in which the slice opening dimension is controlled in response to signals corresponding to the total head of fluid in the headbox, the rate of flow of the suspension into the headbox, and the speed of the forming wire which issues from the headbox slice. The slice opening is controlled in an anticipatory manner to compensate for the slow response of the total head in the headbox to changes occurring in response to slurry mass flow rate into and out of the headbox.

U.S. Pat. No. 3,738,910 describes a nozzle adjusting arrangement for a papermaking machine headbox. The structure includes a cylindrical bearing which is supported by a wall structure on the headbox for rotation about a horizontal axis. The upstream edge of the upper lip of the stock discharge nozzle is journaled in a socket defined in the outer periphery of the cylindrical bearing for supporting the upstream edge of the upper lip relative to the bearing. A linkage connected to the cylindrical bearing rotates the bearing about its central axis and moves the upper lip, the upstream and downstream edges thereof moving along paths each having a horizontal component.

Another adjustable slice lip is disclosed in U.S. Pat. No. 3,994,773. That patent, however, deals primarily with a means for measuring the vertical displacement of the upper slice lip as a result of signals generated by relative vertical movement between the upper and lower slice lips.

U.S. Pat. No. 3,976,539 describes an adjusting structure for the upper lip of a slice including a support structure which has an elongated substantially horizontal lower region situated adjacent an upper lip of the slice. An elongated strip extends along the lower region of the support structure and projects downwardly beyond the lower region where the strip terminates in an elongated substantially horizontal free edge which defines the upper lip of the slice. An elongated plate which is situated in front of and adjacent the front support structure provides structure for adjusting the strip.

Other patent disclosures dealing with adjustable slice structures will be found in U.S. Pat. Nos. 4,008,123; 4,089,739; 4,326,916; and 4,373,993.

The assignee of the present application markets a slice lip adjuster which is described in manual J006-10004, dated February 1978. This manual describes the headbox slice lip and slice lip adjusters which have become quite conventional in the field. The slice lip is adjusted by means of a series of adjusters spaced across the width of the slice body. The slice lip is held in position against the slice body with a spring-loaded adjusting arm. A spring presses a hook portion on the adjusting arm into a groove of the slice lip which forms a seat with the hook portion and keeps the lip in contact with the slice body. The spring-loaded adjusting arm allows for movement of the slice lip to a relatively small extent (0.015 inch or so).

It has been found in practice that because of the forces involved in moving the slice lip, the slice-adjusting arm compresses the spring, causing the arm to crawl out of the slice lip groove thereby rendering all arm measurements useless.

SUMMARY OF THE INVENTION

The present invention provides a means for limiting the disengagement of the slice adjusting arm from the slice lip to an acceptable amount, while maintaining proper pressure against the slice lip at all times.

In keeping with the present invention, we provide a threaded, headed bolt which passes through an aperture in the adjusting arm and is received in threaded engagement in the slice body. A plug is received in threaded engagement at the head of the bolt, and a compressed coil spring acts between the plug and the adjusting arm urging the adjusting arm toward the slice lip. A tube having an internally threaded portion receives the plug in threaded engagement at one end, and the opposite end of the tube is spaced from the adjusting arm by a small predetermined clearance. Locking means are provided to lock the tube in an adjusted position relative to the plug.

BRIEF DESCRIPTION OF THE DRAWINGS

A further description of the present invention will be made in conjunction with the attached sheet of drawings in which:

FIG. 1 is a view in perspective of a slice lip adjuster mechanism according to the present invention;

FIG. 2 is a fragmentary view partly in elevation and partly in cross section of the slice lip adjuster in position at the slice of the headbox feeding a fiber suspension onto a forming wire;

FIG. 3 is an enlarged view in cross section of the improved adjusting mechanism of the present invention; and FIG. 4 is a front elevational view of the device shown in FIG. 3.

DESCRIPTION OF THE PREFERRED EMBODIMENTS

In FIG. 1 reference numeral 10 indicates generally a slice lip adjuster which operates on a slice body including a vertical body wall 11 and an upper slice body wall 12. A slice lip 13 abuts the slice body wall 12 and is movable slightly relative thereto for purposes of adjustment.

A series of spaced adjusters 14, 15 and 16 are positioned along the vertical body wall 11 for incremental adjustment of the slice opening. The adjusters 14 through 16 each have an adjusting arm 17, 18 and 19, respectively, the structure of which will be explained in a succeeding portion of this specification.

Minute adjustments of the slice opening are accomplished by micro-adjusters 20, 21 and 22. Dial indicators 23, 24 and 25 indicate the movement of the arm in thousandths of an inch. The micro-adjustment is made by means of adjusting knobs 26, 27 and 28.

As seen in FIG. 2, the slice body wall 12 cooperates with a lower slice wall 29 to determine the opening of the slice and thus the flow from the headbox onto a forming wire 30 trained about a roll 31 for control of the sheet profile.

The specific improvements of the present invention are best illustrated in FIGS. 3 and 4 of the drawings. In FIG. 3 there is shown the adjusting arm 17 having an aperture 32 extending therethrough. Passing through the aperture is a bolt 33 having a threaded end portion 34 received within a threaded boss in a stiffener 35 fixedly secured to the vertical body wall 11.

The lower end of the adjusting arm 17 is formed with a hook portion 36 which is arranged to be received in a groove 37 formed in the slice lip 13.

The hook portion 36 is held in the groove 37 by the action of a coil spring 38 located within a tube 39. One end of the coil spring 38 is bottomed against a washer 40 which surrounds the aperture 32. The opposite end of the spring 38 presses against a plug 41 which has its outer periphery in threaded engagement with internal threads of the tube 39. The inner diameter of the plug 41 is also threaded to accommodate a threaded end portion 42 located in close proximity to a headed end portion 43 of the bolt 33.

The headed end 43 of the bolt includes a socket 44 to receive a suitable wrench for adjusting the position of the bolt 33. The plug 41 has flat portions 45 which are adapted to be engaged by an adjustable wrench or the like. Formed in the tube 39 is a plurality of peripherally spaced slots 46. Movement of the tube along the plug 41 is thus accomplished by means of a spanner wrench or the like engaging the slots 46.

The headed end portion 43 of the bolt 33 acts against a locking washer 47 which has a tine 48 arranged to be received in ay one of the slots 46.

A set screw 49 is provided through the adjusting arm 17 and is arranged to abut the stiffener 35 of the slice chamber. The abutment of the set screw 49 with the stiffener 35 leaves a clearance labeled "a" which is typically about 0.001 inch.

The structure shown in FIGS. 3 and 4 limits the disengagement of the slice adjusting arm 17, 18 and 19 from the slice lip 13 to an acceptable amount, while maintaining proper pressure against the slice lip 13 at all times. By proper adjustment of the position of the bolt 33, the tube 39, and the plug 41, the clearance labeled "b" between the end of the tube 39 and the front surface of the adjusting arm 17 can be controlled within precise limits, on the order of 0.001 inch. The tine 48 of lock washer 47 can then be used to lock the tube 39 in place to prevent the clearance "b" from changing.

It will be seen that the present invention thus provides an effective arm disengagement limiting means for the adjusting arm from the slice lip while maintaining proper pressure against the slice lip at all times.

It will be evident that various modifications can be made to the described embodiments without departing from the scope of the present invention.

We claim as our invention:

1. In a papermaking machine for depositing a fiber suspension onto a forming wire through a slice opening of adjustable dimension, a slice body, a slice lip abutting said slice body and movable relative thereto, an adjusting arm having an aperture extending therethrough, engagement means interconnecting said adjusting arm and said slice lip, a threaded, headed bolt passing through the aperture in said adjusting arm and received in threaded engagement in said slice body, a plug received in threaded engagement at the head of said bolt, a compressed spring acting between said plug and said adjusting arm, a tube having two opposing ends and having an internally threaded portion receiving the plug in threaded engagement at one of said ends, the opposite end of said tube being spaced from said adjusting arm by a small predetermined clearance, and locking means locking said tube in an adjusted position relative to said plug.

2. A machine according to claim 1 in which:

said engagement means comprises a groove in said slice lip and a hook portion on said adjusting arm which fits into said groove.

3. A machine according to claim 1 wherein:

said tube has peripherally spaced slots formed therein, and said locking means includes a locking washer having a tine arranged to be received in any one of said slots.

4. A machine according to claim 1 which includes limit means limiting the extent to which said adjusting arm can approach said slice body.

5. In a papermaking machine for depositing a fiber suspension onto a forming wire through a slice opening of adjustable dimension, a slice body, a slice lip abutting said slice body and movable relative thereto, said slice lip having a groove therealong, an adjusting arm having an aperture extending therethrough, said adjusting arm extending substantially perpendicular relative to said slice lip and having a hook portion received in said groove, a threaded bolt passing through the aperture in said adjusting arm and received in threaded engagement in said slice body, said bolt having an enlarged headed end, a plug received in threaded engagement with said bolt at the headed end of said bolt, a compressed coil spring having two opposing ends and having one of said ends bottomed against the inner end of said plug and its opposite end acting against said adjusting arm to urge said hook portion into firmly seated relation within said groove of said slice lip, a tube having two opposing ends and having an internally threaded portion receiving said plug in threaded engagement at one of said ends, the opposite end of said tube being spaced from said adjusting arm by a small predetermined clearance, said tube having peripherally spaced slots formed therein, and a locking washer disposed between said plug and the headed end of said bolt, said washer having a radially extending tine thereon arranged to be received in any one of said slots in said tube to lock said tube in a predetermined position.

* * * * *